US005121578A

United States Patent [19]

Holz

[11] Patent Number: 5,121,578

[45] Date of Patent: Jun. 16, 1992

[54] SLAT WALL DECORATING SYSTEM

[75] Inventor: Richard W. Holz, Mesa, Ariz.

[73] Assignee: Holz Plastics, Inc. dba HPI, Mesa, Ariz.

[21] Appl. No.: 647,458

[22] Filed: Jan. 28, 1991

[51] Int. Cl.[5] ..... E04B 2/02

[52] U.S. Cl. ..... 52/506; 52/510; 52/536

[58] Field of Search ..... 52/36, 536, 506, 510, 52/78, 5, 385

[56] References Cited

U.S. PATENT DOCUMENTS

| | | | |
|---|---|---|---|
| 2,033,908 | 3/1936 | Conn . | |
| 2,832,102 | 4/1958 | Amoruso . | |
| 2,847,777 | 8/1958 | Page . | |
| 2,888,983 | 6/1959 | Toti | 52/506 |
| 3,149,436 | 9/1964 | Varlonga . | |
| 3,181,663 | 5/1965 | Mason . | |
| 3,229,398 | 4/1966 | Kopatich . | |
| 3,274,739 | 9/1966 | Gregoire . | |
| 3,678,641 | 7/1972 | Englund . | |
| 3,906,696 | 9/1975 | Poter et al. | 52/536 |
| 3,939,584 | 2/1976 | Trame . | |
| 4,134,244 | 1/1979 | Sjölandee | 52/536 X |
| 4,211,379 | 7/1980 | Morgan et al. | 52/36 X |
| 4,328,653 | 5/1982 | Anderie . | |
| 4,591,058 | 5/1986 | Amstutz et al. | 52/36 X |
| 4,640,064 | 2/1987 | Goodworth . | |
| 4,671,041 | 6/1987 | Rijnders . | |

FOREIGN PATENT DOCUMENTS

| | | | |
|---|---|---|---|
| 2152662 | 4/1973 | Fed. Rep. of Germany | 52/510 |
| 0032298 | 7/1962 | Finland | 52/506 |
| 0943962 | 12/1963 | United Kingdom | 52/510 |

*Primary Examiner*—David A. Scherbel
*Assistant Examiner*—Robert Canfield
*Attorney, Agent, or Firm*—LaValle D. Ptak

[57] ABSTRACT

An easily installed and readily changed decorative surface for commercial slat wall structures is accomplished by providing decorative, elongated wall panel cover strips, each having inturned flanges on the opposite edges thereof. These flanges snap-fit into place over the edges of adjacent ones of the spaced parallel grooves in the panels of the slat wall structure. The slat wall panels are attached to the underlying wall by means of fasteners located anywhere on the slat wall panels, including the major surfaces thereof between the grooves. The decorative cover strips then cover the fasteners, as well as the joints between adjacent panels of the underlying slat wall structure.

10 Claims, 1 Drawing Sheet

SLAT WALL DECORATING SYSTEM

BACKGROUND OF THE INVENTION

Specialized structural wall panels and ceiling panels have been manufactured in a variety of different forms for commercial and residential installations. Popular systems, particularly for commercial buildings, include suspended ceiling systems which typically include a suspended metal grid to which decorative panels and sound absorbent panels are attached. Most suspended ceiling systems are configured to accommodate elongated or rectangular panels which are laid in over flanges formed by the suspension grid. This permits easy access to the space between the grid and the structural ceiling for the purposes of effecting maintenance or replacement of light fixtures, heating ducts and the like.

Four patents which are directed to ceiling systems using decorative panels which are suspended beneath the supporting grid and snap into place, are the Anderle U.S. Pat. No. 4,328,653; Englund U.S. Pat. No. 3,678,641; Rijnders U.S. Pat. No. 4,671,041; and Goodworth U.S. Pat. No. 4,640,064. The ceiling structures which are disclosed in these patents all include a grid network, with panel-engaging tabs on it, to permit decorative ceiling panels to be snapped into place onto the grid. Panels of this type are distinguished from laid-in panels which, essentially, lay on top of the grid, whereas these snap-in panels are suspended from the grid, below it.

A popular wall configuration which is widely used in retail stores for accommodating frequent changes of hangers and fixtures on the wall is known as a slat wall system. Slat wall systems include basic structural panels, typically made of pressed-board or similar materials, and typically furnished in 4' by 8' sheets. These panels have a series of parallel horizontal grooves formed across them, and the grooves are undercut on both edges to form a generally dovetail cross-sectional configuration. The slat wall panels usually are pre-finished with a suitable finish, such as laminated plastic or painted surfaces.

To install such standard pre finished slat wall panels without marring the finish, it is necessary to insert the fasteners, such as nails or screws, into the panels through the grooves; so that the fasteners do not show through the pre-finished surfaces between the various grooves. This causes the fasteners to be placed in the thinnest parts of the panels, since the grooves undercut a substantial part of the thickness of the panel sections. In addition, because the fasteners are recessed into the grooves, considerable care must be taken by the workman installing the panels to avoid damaging the finished surface adjacent the edges of the grooves. This is a significant disadvantage, since the labor costs for installing these panels are considerably increased over what those costs would be if the panels could be attached through any portion of the panel.

Another disadvantage of conventional slat wall structures is that if a decision is made to change the color, the entire panel must be removed and replaced with a new pre-finished panel in the desired color. Similarly, if a portion of a panel is damaged, it is necessary to replace the entire panel, particularly when a laminated plastic finish of the type used in kitchen countertops or the like is used for the decorative finish to the panel.

The Varlonga U.S. Pat. No. 3,149,436 discloses a system utilizing narrow panels for covering a wall. The panels fit under portions of spaced support brackets which are attached to the wall to provide the desired finished surface. This is not a slat wall system.

A different approach for providing a wall surface finish is disclosed in the Amoruso U.S. Pat. No. 2,832,102. This patent discloses a system for holding interlocking tile panels on a frame which is attached to a wall. The tile panels are uniquely configured to attach to the frame, and the end result is to produce a wall finish which appears to be made of brick or other suitable tile.

The Mason U.S. Pat. No. 3,181,663 discloses a system for attaching molding strips onto automobiles in such a way that the attaching device is completely concealed. A holding strip first is secured to the automobile body panel, and this strip has clip extensions in two parallel rows on it. The molding strips have in-turned edges which are secured in place over the clips by simply pressing them over the molding strip onto the mounting panel. The resilient edges of the molding strip pop into place over the clips.

Although several of the prior art patents described above include attaching means for securing a decorative element over an underlying frame to conceal the means by which the frame is attached to the surface to be covered, none of these patents are directed to a simple and efficient way for providing a decorative surface to a slat wall system.

Accordingly, it is desirable to provide a slat wall decorating system which facilitates the initial installation of a slat wall system, is easy to use, is inexpensive, and which permits decorating changes to be made without removing the underlying structural slat wall panels.

SUMMARY OF THE INVENTION

Accordingly, it is an object of this invention to provide an improved slat wall system.

It is an additional object of this invention to provide an improved decorating surface for a slat wall system.

It is another object of this invention to provide interchangeable decorative cover strips for changing the surface appearance of a slat wall system, as desired.

In accordance with a preferred embodiment of this invention, slat wall panels of conventional configuration are installed in an unfinished state, so far as the surface finish is concerned. Elongated decorative cover strips then are snap-fit into place over the surface of the slat wall system between adjacent parallel grooves in the panels. The decorative strips have a generally C-shaped cross section, with in-turned flanges on opposite edges. This permits one of the flanges to engage one edge of a groove in slat wall panel, and the other of the flanges engages the facing edge of the next adjacent groove. The decorative cover strips are made of pultruded resins, extruded plastic, or extruded aluminum, having the desired surface finish. The cover strips are installed in a final step, after the basic slat wall structural panels are attached to the wall; so that no damage to the final decorative surface occurs during installation.

DETAILED DESCRIPTION

Figure 1:
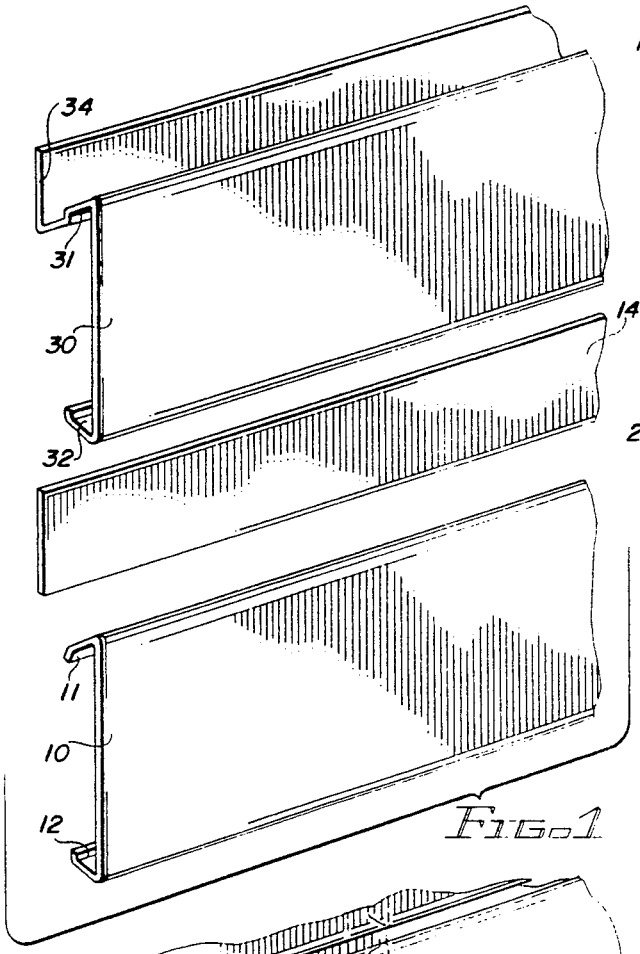
FIG. 1 is a partially cut-away perspective view, illustrating two versions of a preferred embodiment of the invention.

Reference now should be made to the drawing in which the same components have the same reference numbers in the various figures. FIG. 1 illustrates two different sets of elongated decorative cover strips 10 and 30 which may be used to provide the desired decorative surface to a conventional commercial slat wall structure.

As shown in FIG. 1, the elongated decorative cover strips have one or the other of two different configurations. The lower strip 10 comprises an elongated flat panel with inwardly turned flanges 11 and 12 on each of the edges. This provides a generally flattened C-shaped, cross-sectional configuration to the cover strip 10, as is most readily apparent from an examination of the cross-sectional view in FIG. 2.

Figure 2:
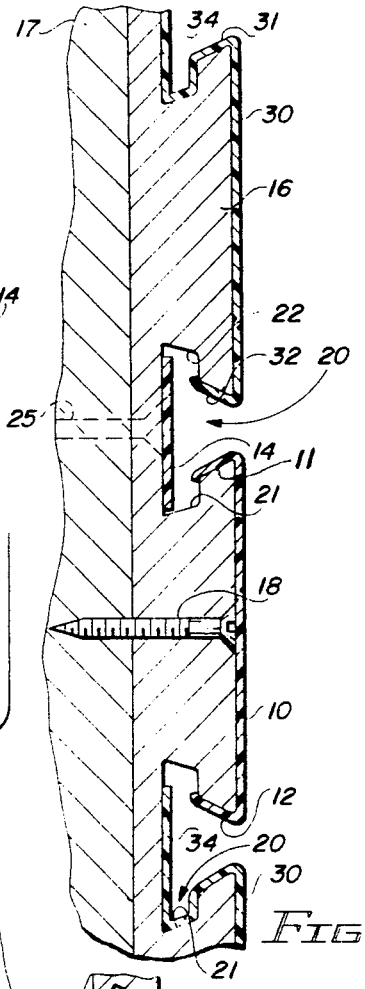
FIG. 2 is a cross-sectional view of the embodiments of FIG. 1 in a typical installation.

As shown in the upper portion of FIG. 2, the cover strip 10 is used to provide a decorative surface for the areas between the grooves of a standard, unfinished slat wall structural wall panel 16 (shown in cross section in FIG. 2). As is well known, the conventional slat wall panel 16 has elongated parallel spaced grooves 20 extending horizontally throughout the length of the panel; and these grooves 20 are undercut on opposite edges at 21 and 22, to form a generally dove-tail configuration in the panel These undercut grooves then permit a variety of accessories, such as hangers and the like, to be inserted into the grooves 20 and supported thereby, to allow storekeepers to create, and frequently change, displays of goods on the walls which are covered with the slat wall panels 16.

As illustrated in FIG. 2, the panel 16 may be secured to the underlying wall 17 by means of threaded fasteners 18, located anywhere on the surface of the slat wall panel 16. This is in contrast to the conventional manner of attaching slat wall panels by means of threaded fasteners 25, located in the slots 20. It is readily apparent that it is much easier, from a construction standpoint, to attach the threaded fasteners 18 through the large flat surfaces of the panel 16, rather than through the relatively narrow grooves 20. In the past, however, since the slat wall panels 16 were pre-finished, it was necessary to install the screws in the positions 25 shown in FIG. 2, since installation through the surfaces between the grooves would disfigure the panels and mar the surface finish.

When the decorative cover strips 10 are employed to cover the surface of the slat wall panel 16 between the grooves 20, an additional flat decorative strip 14 is placed in the grooves 20 to provide a cohesive and finished decorative look to the installation. The cover strips 10 and the strips 14 are made of relatively thin material (typically, under 0.030 inches) to maintain sufficient resiliency to permit the inwardly turned edges 11 and 12 to pop into place or snap into place by first hooking, for example, the upper flange 11 over the lower edge of the groove 20 and then pushing downward on the panel 10 to snap the lower flange 12 over the upper edge of the next lower adjacent groove in the slat wall panel 16. The resilient material of the flat, elongated, rectangular strip 14 also permits it readily to be inserted into the grooves 20, as illustrated in the top half of FIG. 2.

A different cover strip configuration 30 also may be employed in place of the combination of the cover strip 10 and the separate flat decorative strip 14. The cover strip 30 shown in the upper portion of FIG. 1 and the lower half of FIG. 2, has substantially the same C-shaped cross-sectional configuration as the strip 10, and includes inwardly turned flanges 31 and 32 which correspond to the flanges 11 and 12 of the cover strip 10. The flange 31, however, extends away from the surface 20 to a greater depth than the flange 32, and then turns outwardly, away from the edge to which the flange 31 is attached, to form a flat extension leg 34 which parallels the main surface of the cover strip 30, as is readily ascertained from an examination of FIG. 1.

In FIG. 2, the cover strip 30 has been inverted from the position in FIG. 1 and is attached to the lower one of the two outer surfaces of the slat wall panel 16, shown in FIG. 2. As is apparent from an examination of FIG. 2, the extension leg 34 covers the bottom or exposed portion of the slot 20, much in the same manner as the separate flat strip 14. The installation of the cover strip 30 with the extension leg 34, however, eliminates the extra step which is required to install the flat decorative strip 14 used with the cover strip 10.

The cover strips 10 and 30 may be made of any suitable material, such as thermo-plastic or aluminum, both of which are conveniently extruded to the shape shown in FIG. 1. In addition, the cover strips 10 and 30 may be made of pultruded thermo-setting resins, if desired. As is well known, the manufacturing techniques for such products include various types of surface finishes in a variety of different colors; so that the decorative possibilities for the cover strips 10 and 30 are quite extensive.

Figure 3:
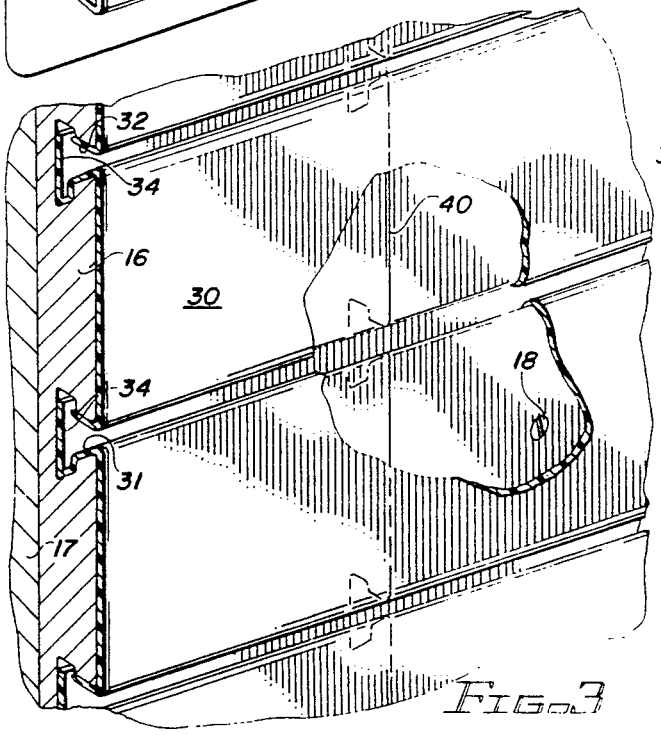
FIG. 3 is a partially cut-away cross-sectional perspective view of the installation of a preferred embodiment of the invention.

FIG. 3 illustrates the manner in which the decorative cover strips 30 (or strips 10, if desired) are used to cover the joints 40 between adjacent flat wall structure panels, and also, cover the exposed portions of the threaded fasteners 18. This is not possible with standard pre-finished slat wall systems; so that the slat wall decorating system which is shown in the drawing and described above, clearly provides a superior, clean finished look to the final installation.

Figure 4A:
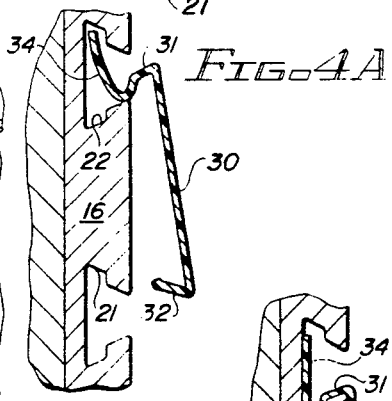
FIGS. 4A and 4B illustrate the manner of installing one of the preferred embodiments of the invention on a slat wall panel.
Figure 4B:
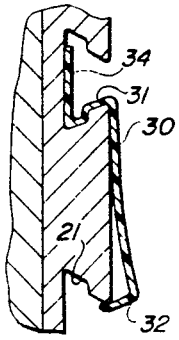

FIGS. 4A and 4B show the manner of installing the cover strip 30, with the leg extension 34, over the slat wall 16, between adjacent grooves 20. The first step is to insert the leg 34 into the groove (FIG. 4A) and then press the lower edge to pop the flange 31 into position, as illustrated in FIG. 4B. Once the flange 31 is in position, pressure along the edge having the flange 32, causes that flange to pop into the final assembled position, which is shown in the cross-sectional views of both FIGS. 2 and 3.

To remove any of the cover strips 10 or 30 from the underlying slat wall panel, to replace a damaged cover strip or to change the decorative appearance of the slat wall with which the cover strips are used, a reverse of the steps described above for installing the cover strips is effected. Once the cover strips have been removed, new decorative cover strips 10 or 30, finished with different colors or different surface configurations, may be installed to change the appearance of the wall on which the slat wall panels 16 are attached, without necessitating the removal of the underlying structural slat wall panels 16.

The foregoing description of the preferred embodiments of the invention is to be considered as illustrative and not as limiting. Various changes and modifications will occur to those skilled in the art without departing from the true scope of the invention as defined by the appended claims.

I claim:

1. An improvement in decorating a slat wall structure having a flat wall panel with uniformly-spaced parallel grooves located a predetermined distance apart in the surface of such panel, and extending throughout the length thereof, with said grooves each having a predetermined width and being undercut on first and second opposite edges thereof to form a generally dovetail cross-sectional configuration, said improvement including:

a plurality of elongated cover strips, each having a substantially C-shaped cross section with first and second in-turned flanges on opposite edges thereof, with said first flange of each of said cover strips engaging the second edge of a groove in said wall panel, said first flange having a leg attached thereto for extension into and across the width of a groove between the first and second edges thereof, and said second flange of each such cover strip engaging the first edge of the next groove in said wall panel; each of said plurality of cover strips being snap-fit into place over the surface of said wall panel, between adjacent grooves therein, to provide a decorative cover over such surface.

2. The improvement according to claim 1 wherein said cover strips are substantially flat between the in-turned flanges on opposite edges thereof.

3. The improvement according to claim 2 wherein said cover strips are made of resilient material.

4. The improvement according to claim 3 wherein said cover strips are formed of material having a thickness of less than 0.030 inches.

5. The improvement according to claim 4 wherein said cover strips are made of extruded material selected from the class of thermo-plastics and aluminum.

6. The improvement according to claim 4 wherein said cover strips are made from pultruded thermoset resins.

7. The combination according to claim 1 wherein said cover strips are made of resilient material.

8. The improvement according to claim 1 wherein said cover strips are made of extruded material selected from the class of thermo-plastics and aluminum.

9. The improvement according to claim 1 wherein said cover strips are made from pultruded thermoset resins.

10. The improvement according to claim 1 wherein said cover strips are formed of material having a thickness of less than 0.030 inches.

* * * * *